US007464686B2

(12) United States Patent
Oda et al.

(10) Patent No.: US 7,464,686 B2
(45) Date of Patent: Dec. 16, 2008

(54) LEAK FUEL COLLECTION APPARATUS OF INTERNAL COMBUSTION ENGINE

(75) Inventors: Yuji Oda, Nagasaki (JP); Shunichi Mori, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 302 days.

(21) Appl. No.: 10/535,852

(22) PCT Filed: Nov. 19, 2003

(86) PCT No.: PCT/JP03/14730

§ 371 (c)(1),
(2), (4) Date: Jan. 6, 2006

(87) PCT Pub. No.: WO2004/046538

PCT Pub. Date: Jun. 3, 2004

(65) Prior Publication Data

US 2006/0102153 A1 May 18, 2006

(30) Foreign Application Priority Data

Nov. 20, 2002 (JP) ..... 2002-336942

(51) Int. Cl.
*F02B 77/08* (2006.01)
*F02B 77/10* (2006.01)

(52) U.S. Cl. ..... 123/198 D; 123/431

(58) Field of Classification Search ..... 123/198 D, 123/299, 456, 446, 447, 575, 577, 300, 431, 123/1 A, 529; 239/96
See application file for complete search history.

(56) References Cited

U.S. PATENT DOCUMENTS

| | | | | |
|---|---|---|---|---|
| 4,520,774 | A * | 6/1985 | Sitter | 123/300 |
| 5,365,907 | A * | 11/1994 | Dietrich et al. | 123/470 |
| 5,755,210 | A * | 5/1998 | Sato et al. | 123/518 |
| 5,819,708 | A * | 10/1998 | Buratti et al. | 123/468 |
| 6,539,921 | B1 * | 4/2003 | Matsumura | 123/456 |
| 6,601,566 | B2 * | 8/2003 | Gillis et al. | 123/468 |
| 6,604,509 | B1 * | 8/2003 | Hegner | 123/456 |
| 6,712,045 | B1 * | 3/2004 | McCarthy, Jr. | 123/456 |
| 7,059,276 | B2 * | 6/2006 | Yamaoka et al. | 123/1 A |
| 2004/0055576 | A1 * | 3/2004 | McCarthy, Jr. | 123/458 |

FOREIGN PATENT DOCUMENTS

| | | |
|---|---|---|
| JP | 54-15637 | 2/1979 |
| JP | 7-217509 A | 8/1995 |
| JP | 10-281029 A | 10/1998 |

* cited by examiner

*Primary Examiner*—Mahmoud Gimie
(74) *Attorney, Agent, or Firm*—Birch, Stewart, Kolasch & Birch, LLP

(57) ABSTRACT

A leak fuel collection apparatus of the internal combustion engine using leak oil collection pipe fuel is provided, by which the improvement in fuel consumption and exhaust emission can be achieved by improving the combustion condition of the leak fuel mixed with fresh air in the cylinder in correspondence with the engine operating conditions.

The leak oil collection pipe is connected to the intake air pipe of the engine, a leak pipe open/close valve is provided to the leak oil collection pipe for opening or closing the leak pipe, and the leak pipe open/close valve is opened when the engine load at an engine rotation speed exceeds a predetermined value determined for the rotation speed and is closed when the engine load at said rotation speed is equal to or lower than said predetermined value.

14 Claims, 7 Drawing Sheets

FIG. 2

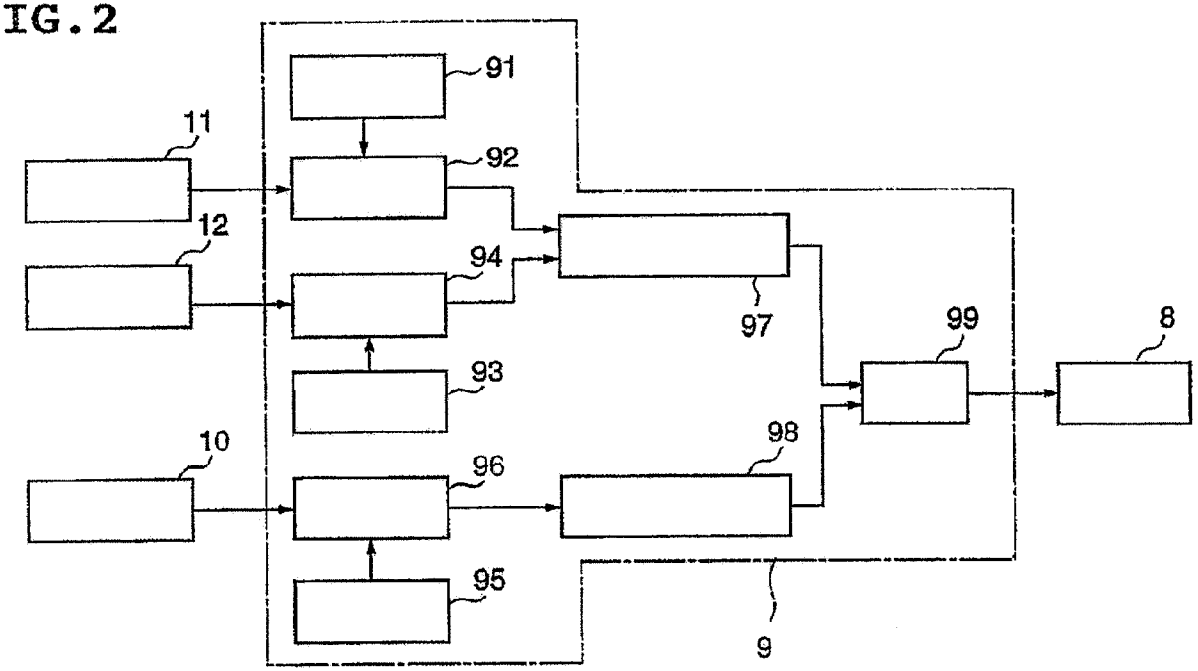

8: Leak pipe open/close valve
9: Controller
10:Leak pipe pressure detector
11:Engine load detector
12:Engine rotation speed detector 91:Switchover load setting section
92:Load comparing section
93:Switchover rotation speed setting section
94:Rotation speed comparing section
95:Switchover pressure setting section
96:Leak pipe pressure comparing section
97:Operating condition related valve openings calculation section
98:Leak pipe pressure related valve openings calculation section
99:Open/close valve control section

LEAK FUEL COLLECTION APPARATUS OF INTERNAL COMBUSTION ENGINE

BACKGROUND OF THE INVENTION

1.Field of the Invention

The present invention relates to an apparatus for collecting the fuel leaked from the fuel injection system of an internal combustion engine through clearances such as a the circumferential clearance of the needle valve, etc. of the fuel injection nozzle for injecting fuel into the cylinder to a leak oil collection pipe through the leak passage in said fuel injection nozzle. The apparatus is particularly applied to an internal combustion engine using low boiling point fuel such as DME (dimethyl ether), LPG(liquefied petroleum gas), etc.

2. Description of the related Art

In a diesel engine having a cylinder into which low boiling point fuel such as DME(dimethyl ether), LPG(liquefied petroleum gas), etc. pressurized into a liquid state, is injected from the injection nozzle the fuel is pressurized in the fuel supply system for supplying the fuel to the injection nozzle and in the fuel injection system, because the fuel must be injected into the cylinder in a liquid state.

Therefore, in the fuel injection system of such a diesel engine, the amount of leaked fuel leaked to the upper part of the fuel injection nozzle through clearances such as the circumferential clearance of the needle valve, etc. in a pressurized liquid state of low viscosity increases, so the leaked fuel is collected to be supplied for combustion, because if the leaked fuel is released into the atmosphere the thermal efficiency of the engine reduces.

Generally, the fuel leaked from the injection nozzle is collected to the fuel supply system to be reused as disclosed in Japanese Laid-Open patent Application No. 9-112732.

However, in the case of a diesel engine using low boiling point fuel, it is conceivable, as the fuel is pressurized in the fuel supply system, to introduce the leaked fuel to the intake air supply passage to be vaporized thereby and supplied into the cylinder together with the fresh air (intake air of the engine) as an air-fuel mixture, instead of returning the leak fuel from the injection nozzle to fuel supply system as is in the case of a diesel engine using light oil or heavy oil as described in said Japanese Laid-Open patent Application No. 9-112732.

When the leaked fuel from the injection nozzle is introduced into the air supply passage to be mixed with the fresh air to be supplied as intake air of the engine, the mixture is extremely lean mixture of the leaked fuel and fresh air, and incomplete combustion with unburned fuel remained is prone to occur in the cylinder.

Particularly, in a low load range with decreased injection amount of fuel into the cylinder, the combustion environment in the cylinder is such that the incomplete combustion of the lean mixture containing the leak fuel is liable to occur, and fuel consumption increases due to the incomplete combustion of the leaked fuel and at the same time the deterioration in exhaust emission is induced due to the generation of harmful matter such as CO(carbon monoxide) and HC(hydro carbon).

SUMMARY OF THE INVENTION

The object of the present invention is, in light of the problems of prior art, to provide an leak fuel collection apparatus of an internal combustion engine, by which apparatus fuel consumption and exhaust emission can be improved by retaining the combustion condition of the lean mixture of the fresh air and the fuel leaked from the injection nozzle in a good state all over the operation range of the engine particularly in an internal combustion engine using low boiling point fuel.

The present invention provides to solve the problems mentioned above, and is directed to a system for collecting the fuel leaked from the fuel injection nozzle for injecting fuel into the cylinder of the engine through clearances such as the circumferential clearance of the needle valve, etc. of the injection nozzle through the leak passage in the injection nozzle to a leak oil collection pipe, wherein said leak oil collection pipe is connected to the intake air passage of the engine, and a leak pipe open/close valve for opening or closing the leak oil collection pipe line is provided to the leak oil collection pipe.

The apparatus is constituted so that said leak pipe open/close valve is opened when the engine load at an engine rotation speed exceeds a predetermined value, and the same is closed when the engine load at said engine rotation speed is equal to or lower than said predetermined value.

It is preferable that the apparatus is provided with:

an engine load detector for detecting the load of the engine, an engine rotation speed detector for detecting the rotation speed of the engine, and a controller which controls the leak pipe open/close valve, based on the detected value of the engine load inputted from the engine load detector and the detected value of the rotation speed inputted from the engine rotation speed detector, such that the leak pipe open/close valve is opened when the detected value of the engine load at an engine rotation speed exceeds a predetermined value, determined based on the rotation speed, and said leak pipe open/close valve is closed when the detected value of the engine load at said engine rotation speed is equal to or lower than said predetermined value.

It is suitable that the apparatus is constituted so that said leak pipe open/close valve is opened when the pressure in the leak oil collection pipe exceeds a predetermined value and the same is closed when the pressure in the leak oil collection pipe is equal to or lower than said predetermined value.

Preferably, the apparatus is provided with:

a leak pipe pressure detector for detecting the pressure in the leak oil collection pipe, and a controller which controls the leak pipe open/close valve, based on the detected value of the pressure inputted from the leak pipe pressure detector, such that the leak pipe open/close valve is opened when the detected value of the pressure in the leak oil collection pipe exceeds a predetermined value and said leak pipe open/close valve is closed when the detected value of the pressure in the leak oil collection pipe is equal to or lower than said predetermined value.

Further, it is suitable that the apparatus is constituted so that said leak pipe open/close valve is opened when the engine load at an engine rotation speed exceeds a predetermined value, determined based on the rotation speed, and at the same time the pressure in the leak oil collection pipe exceeds a predetermined value, and said leak pipe open/close valve is closed when the engine load at said engine rotation speed is equal to or lower than said predetermined value of engine load and at the same time the pressure in the leak oil collection pipe is equal to or lower than said predetermined value of pressure.

Preferably, the apparatus is provided with:

an engine load detector for detecting the load of the engine, an engine rotation speed detector for detecting the rotation speed of the engine, a leak pipe pressure detector for detecting the pressure in the leak oil collection pipe, and a controller which controls the leak pipe open/close valve, based on the detected value of the engine load inputted from the engine load detector, the detected value of the rotation speed inputted from the engine rotation speed detector, and the detected value of the pressure inputted from the leak pipe pressure detector, such that the leak pipe open/close valve is opened when the engine load at an engine rotation speed exceeds a predetermined value, determined based on the rotation speed, and at the same time the pressure in the leak oil collection pipe exceeds a predetermined value or when the engine load at said engine rotation speed is equal to or lower than said predetermined value of load and at the same time the pressure in the leak oil collection pipe exceeds said predetermined value of pressure, and controls the leak pipe open/close valve, such that said leak pipe open/close valve is closed when the detected value of the engine load at said engine rotation speed is equal to or lower than said predetermined value of load and at the same time the detected value of the pressure in the leak oil collection pipe is equal to or lower than said predetermined value of pressure.

As mentioned above, in a diesel engine having a cylinder into which the fuel having low boiling temperature such as DME(dimethyl ether), LPG(liquefied petroleum gas), etc. pressurized into a liquid state of low viscosity is injected from the injection nozzle into the cylinder is supplied to the injection nozzle, fuel leakage from the circumferential clearance of the needle valve, etc. of the injection nozzle toward the upper part of the injection pump increases.

However, according to the present invention, the fuel leaked from the injection nozzle is introduced to the intake air passage via a leak oil collection pipe line, a leak pipe open/close valve is controlled to open or close the leak pipe, and the valve is opened when the engine is operated in a high load range to introduce the leaked fuel into the intake air passage to be mixed with the intake air and supplied to the cylinder of the engine, whereby the leaked fuel can be burned well in the cylinder without unburned fuel remained.

On the other hand, when the engine is operated in a low load range, as the amount of the leak fuel is small and the pre-mixture thereof with the intake air is very lean, the complete combustion of the leak fuel is difficult. Therefore, by closing the leak pipe valve to stop the introduction of the leaked fuel into the intake air passage, the increase in fuel consumption and deterioration in exhaust emission can be evaded.

Further, by closing the leak pipe valve until the pressure in the leak oil collection pipe reaches a predetermined value in order to store the leaked fuel in the leak oil collection pipe and opening the valve when the pressure reaches said predetermined value to introduce the leaked fuel increased in pressure into the intake air passage, a denser fuel/air pre-mixture can be supplied to the cylinder as intake air of the engine and good combustion with lesser fuel remained unburned can be realized.

Therefore, by opening the valve to introduce the leaked fuel into the intake air passage of the engine when the engine is operating in the range of high load, the leaked fuel introduced into the cylinder in the state mixed with intake air can be burned well in the cylinder without unburned fuel remained, and by closing the valve in order to store the leaked fuel in the leak oil collection pipe until the pressure in the leak oil collection pipe reaches a certain value and opening the valve when the pressure reaches said certain value to introduce the leaked fuel increased in pressure in the leak oil collection pipe into the intake air passage to be mixed with intake air when the engine is operating in the range of low load, denser fuel/air mixture is supplied to the cylinder and good combustion with lesser fuel remained unburned can be realized even in the range of low load operation.

In this way, the leak fuel can be burned in good combustion conditions in all load range of the engine.

BRIEF DESCRIPTION OF THE DRAWINGS

FIG. 2 is a control block diagram of the leak fuel collection apparatus.

DETAILED DESCRIPTION OF THE INVENTION

An embodiment of the present invention will now be described with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
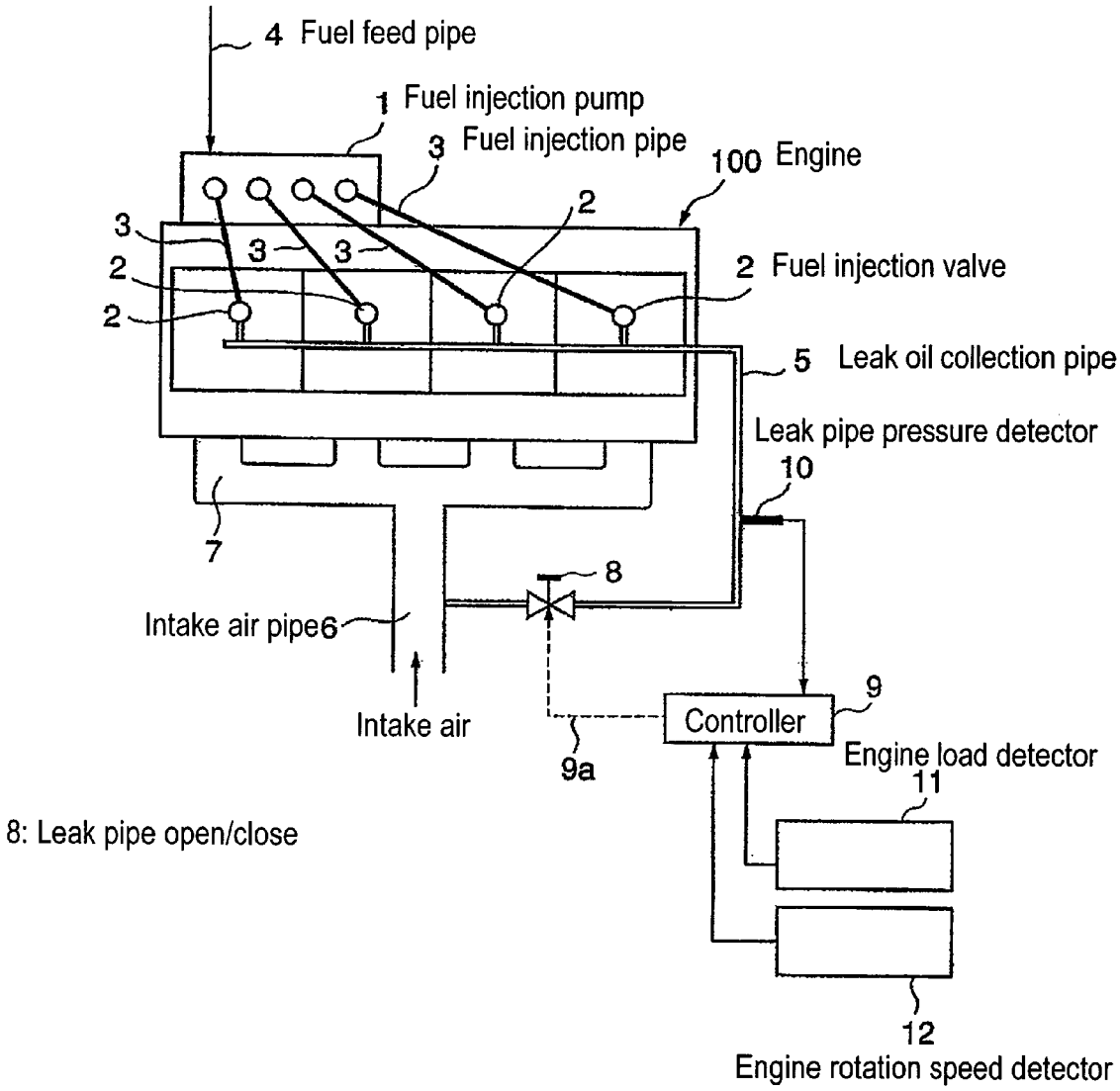
FIG. 1 is a plan view of an embodiment of the leak fuel collection apparatus of a diesel engine according to the present invention.

Referring to FIG. 1 showing the overall configuration of the leak fuel collection apparatus of a diesel engine according to the present invention, reference numeral 100 is an engine (diesel engine), 2's are fuel injection nozzles (detailed later) mounted to each of the cylinders of the engine 100, 1 is a fuel injection pump which compresses fuel to send it to each injection nozzle 2 by way of each fuel injection pipe 3, and 4 is a fuel supply pipe for supplying fuel to the fuel injection pump 1 from a fuel tank not shown in the drawing by means of a fuel supply pump not shown in the drawing.

Reference numeral 7 is the intake manifold of the engine 100, and 6 is the intake air pipe connecting with the intake manifold 7.

In the embodiment, DME(dimethyl ether), LPG(liquefied petroleum gas), etc. is used as fuel for the engine 100. The present invention can be applied also in the case light oil or heavy oil is used as fuel.

The structure of said fuel injection pump 1 is the same as that of a conventional in-line, jerk fuel injection pump and detailed explanation thereof is omitted.

Figure 3:
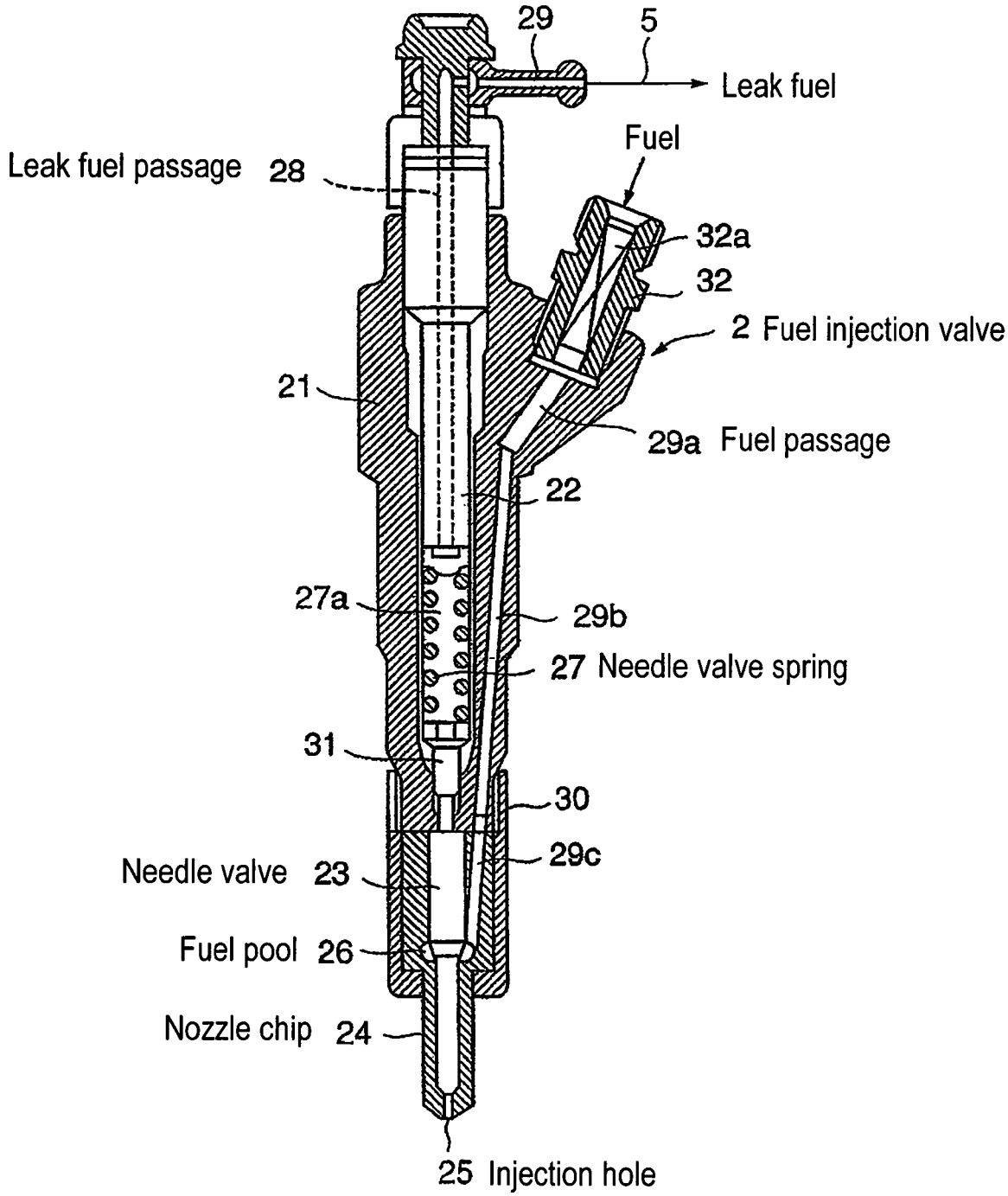
FIG. 3 is a cross sectional view of the injection nozzle in the leak fuel collection apparatus.

Reference numeral 5 is a leak oil collection pipe (leak pipe line) connecting the leak fuel passage 28 and leak fuel connector 29 of the injection nozzle 2 shown in FIG. 3 to said intake air pipe 6. Reference numeral 8 is a leak pipe valve attached to the leak oil collection pipe 5 for opening or closing the passage in the leak oil collection pipe line, the valve being composed of an electromagnetic valve capable of controlling flow rate.

Reference numeral 10 is a leak pipe pressure detector for detecting the pressure in the leak oil collection pipe 5, 11 is an engine load detector for detecting the load (engine output) of the engine 100, 12 is engine rotation speed detector for detecting the rotation speed of the engine 100, and 9 is a controller, of which is detailed later, and to which is inputted the pressure in the leak oil collection pipe 5 detected by the leak pipe pressure detector 10; the engine load detected by the engine load detector 11, and the engine rotation speed detected by the engine rotation speed detector 12. The control signal of said controller 9 is sent to the leak pipe open/close valve 8 via a control line 9*a*.

Referring to FIG. 3 showing the detail of said injection nozzle 2, reference numeral 21 is a nozzle body, 24 is a nozzle chip attached to the nozzle body 21 at its end by means of a nozzle nut 30 screwed in to the nozzle body 21, and 25 is one of a plurality of nozzle holes drilled in the end part of the nozzle chip 24. Reference numeral 26 is an annular shaped fuel pool formed in the nozzle chip 24, each of 29*a*, 29*b*, 29*c* is a fuel passage provided in the nozzle body 21 and the nozzle chip 24. Reference numeral 32 is a fuel intake connector with a filter 32*a* accommodated therein, the connector being screwed into the nozzle body 21 at the upper part thereof. The fuel pressure-fed from the fuel injection pump 1 via the fuel injection pipe 3 is introduced to the fuel pool 26 by way of the fuel passage 29*a*, 29*b*, and 29*c*.

Reference numeral 23 is a needle valve received in the nozzle chip 24 for reciprocal sliding, the fuel pool 26 is communicated or disconnected to the injection holes 25 in accordance with the unseating or seating of the tip of the needle valve 23 onto the seat formed in the nozzle chip 24.

Reference numeral 27 is a needle valve spring accommodated in the needle valve spring room 27*a* of the nozzle body 21, 31 is a lower spring retainer provided between the top end of the needle valve 23 and the lower end face of the needle valve spring 27, and 22 is an upper spring retainer for supporting the needle valve spring 27 at the upper end face thereof. The opening pressure of the needle valve 23 is determined by the spring force of the needle valve spring 27.

Reference numeral 28 is a leak fuel passage which passes through the center part of the upper spring retainer 22 to communicate the needle valve spring room 27*a* with the leak fuel connector 29.

Next, the operation of the leak fuel collection apparatus will be explained with reference to FIG. 2.

The detected value of the load(output) of the engine 100 detected by the engine load detector 11 is inputted to the load comparing section 92 of the controller 9, and the detected value of the rotation speed of the engine 100 detected by the engine rotation speed detector 12 is inputted to the rotation speed comparing section 94 of the controller 9.

On the other hand, the detected value of the pressure in the leak oil collection pipe 5 detected by the leak pipe pressure detector 10 is inputted to the leak pressure comparing section 96 of the controller.

Reference numeral 91 is a switchover load setting section, in which is set leak pipe valve switchover load $L_0$ which is the lower limit value of the engine load when the leaked fuel stored in the leak oil collection pipe 5 is supplied into the intake pipe 6, the switchover load $L_0$ of opened leak pipe valve being related to the switchover rotation speed which is set in the switchover rotation speed setting section 93 of the controller 9.

Figure 4A:
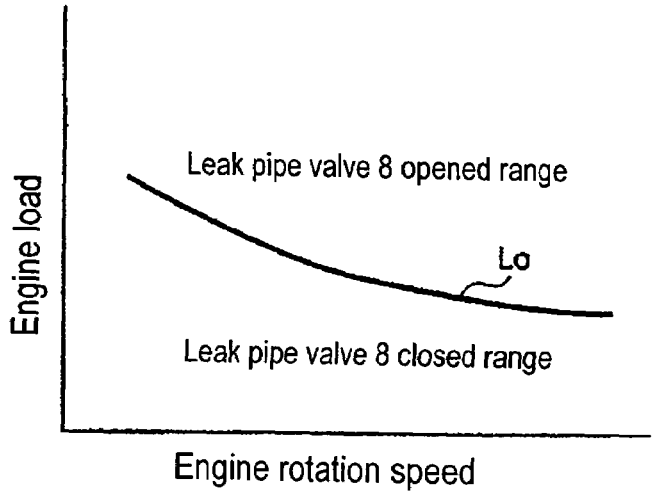
FIG. 4A and FIG. 4B are illustrations for explaining the operation of the leak pipe valve responding to engine load.

To be more specific, the switchover load $L_0$, which is defined as a function of engine rotation speed as shown in FIG. 4A, is set in the switchover load setting section 91 and switchover rotation speed setting section 93. When the engine is operating in the high load range above the switchover load $L_0$, the leak pipe valve 8 is opened, and when the engine is operating in the low load range below the switchover load $L_0$, the leak pipe valve 8 is closed, the switchover load $L_0$ changing depending on the engine rotation speed.

Reference numeral 95 is the switchover leak pressure setting section of the controller 9 in which is set leak pipe valve switchover pressure $P_0$, above which pressure the leak pipe valve 8 is opened and the leak fuel stored in the leak oil collection pipe 5 is supplied to the intake air pipe 6.

In the load comparing section 92, the detected value of the engine load detected by the engine load detector 11 is compared with the leak pipe valve switchover load $L_0$ set in the switchover load setting section 91, and in the rotation speed comparing section 94, the detected value of the engine rotation speed detected by the engine rotation speed detector 12 is compared with the switchover rotation speed set in the switchover rotation speed setting section 93, and these results of comparison are outputted to the operating condition/valve openings calculation section 97 of the controller 9.

In the leak pressure comparing section 96, the detected value of the pressure in the leak oil collection pipe detected by the leak pipe pressure detector 10 is compared with the leak pipe valve switchover pressure $P_0$ set in the switchover pressure setting section 95, and the result of comparison is outputted to the leak pipe pressure related valve openings calculation section 98 of the controller 9.

The operating condition related valve openings calculation section 97 outputs a signal, based on the result of the comparison of the detected value of the engine load with the leak pipe valve switchover load $L_0$ in the load comparing section 92 and the result of the comparison of the detected engine rotation speed with the leak pipe open/close switchover rotation speed in the rotation speed comparing section 94, to open the leak pipe valve 8 to the open/close valve control section 99 of the controller 9 when the detected engine load is higher than the leak pipe valve switchover load $L_0$, that is, when the engine load is in the range of leak pipe valve open in FIG. 4A.

When the detected engine load is lower than the leak pipe valve switchover load $L_0$, that is, when the pressure is in the range of leak pipe valve close in FIG. 4A, the operating condition related valve openings calculation section 97 outputs a signal, to the valve control section 99 to close the leak pipe valve 8.

Figure 5A:
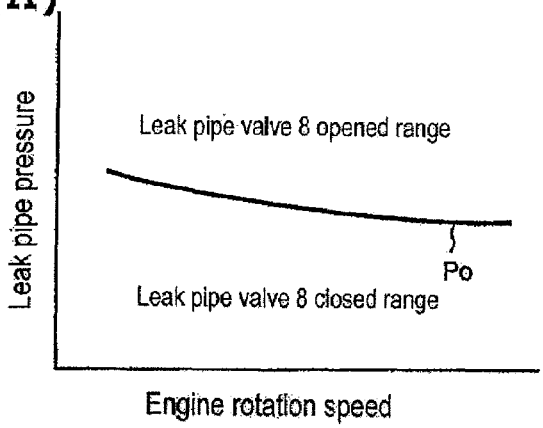
FIG. 5A and FIG. 5B are illustrations for explaining the operation of the leak pipe valve responding to the pressure in the leak pipe.

On the other hand, the leak pressure related valve openings calculation section 98 outputs a signal, based on the result of the comparison of the detected value of the pressure in the leak oil collection pipe with the leak pipe valve switchover pressure P.sub.0 in the leak pressure comparing section 96, to open the leak pipe valve 8 to the valve control section 99 when the detected pressure in the leak oil collection pipe is higher than the leak pipe valve switchover pressure $P_0$, that is, when the pressure is in the range of leak pipe valve open in FIG. 5A, When the detected pressure in the leak oil collection pipe is lower than the leak pipe valve switchover pressure $P_0$, that is, when the pressure is in the range of leak pipe valve close in FIG. 5A, the leak pressure related valve openings calculation section 98 outputs a signal to the valve control section 99 to close the leak pipe valve 8.

When the detected engine load is higher than the leak pipe valve changeover load $L_0$ (when the detected load is in the range of valve open in FIG. 4A), the output signal from the operating condition related valve openings calculation section 97 to open the leak pipe valve 8 is inputted to the valve control section 99, and the valve control section 99 allows the leak pipe valve 8 to open irrespective of the result of the comparison of the detected value of the pressure in the leak oil collection pipe with the leak pipe valve switchover pressure $P_0$.

When the detected engine load is lower than the leak pipe valve changeover load $L_0$ (when the detected load is in the range of valve close in FIG. 4A), the output signal outputted from the operating condition related valve openings calculation section 97 to close the leak pipe valve 8 is inputted to the valve control section 99, and the valve control section 99 allows the leak pipe valve 8 to close.

When the detected pressure in the leak oil collection pipe is higher than the leak pipe valve changeover pressure $P_0$ (when the detected load is in the range of valve open in FIG. 5A) and the output signal from the leak pressure related valve openings calculation section 97 to open the leak pipe valve 8 is inputted to the valve control section 99, the valve control section 99 allows the leak pipe valve 8 to open even if the detected engine load is lower than the leak pipe valve switchover load $L_0$.

When the detected pressure in the leak oil collection pipe is lower than the leak pipe valve changeover pressure $P_0$ (when the detected pressure is in the range of valve close in FIG. 5A), and the output signal outputted from the leak pressure related valve openings calculation section 98 to close the leak pipe valve 8 is inputted to the valve control section 99, the valve control section 99 allows the leak pipe valve 8 to close.

Figure 4B:
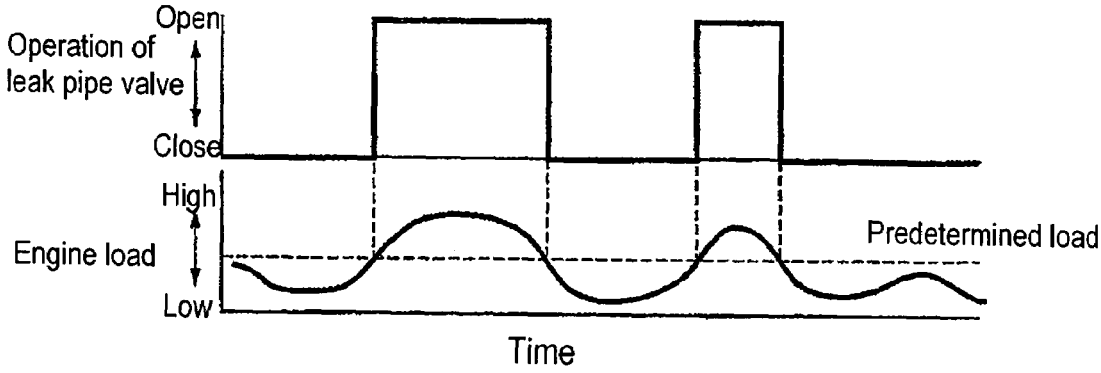
Figure 5B:
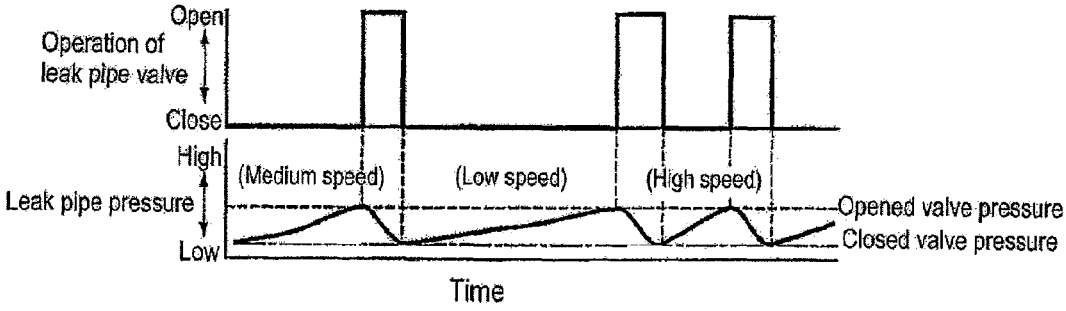
Figure 6:
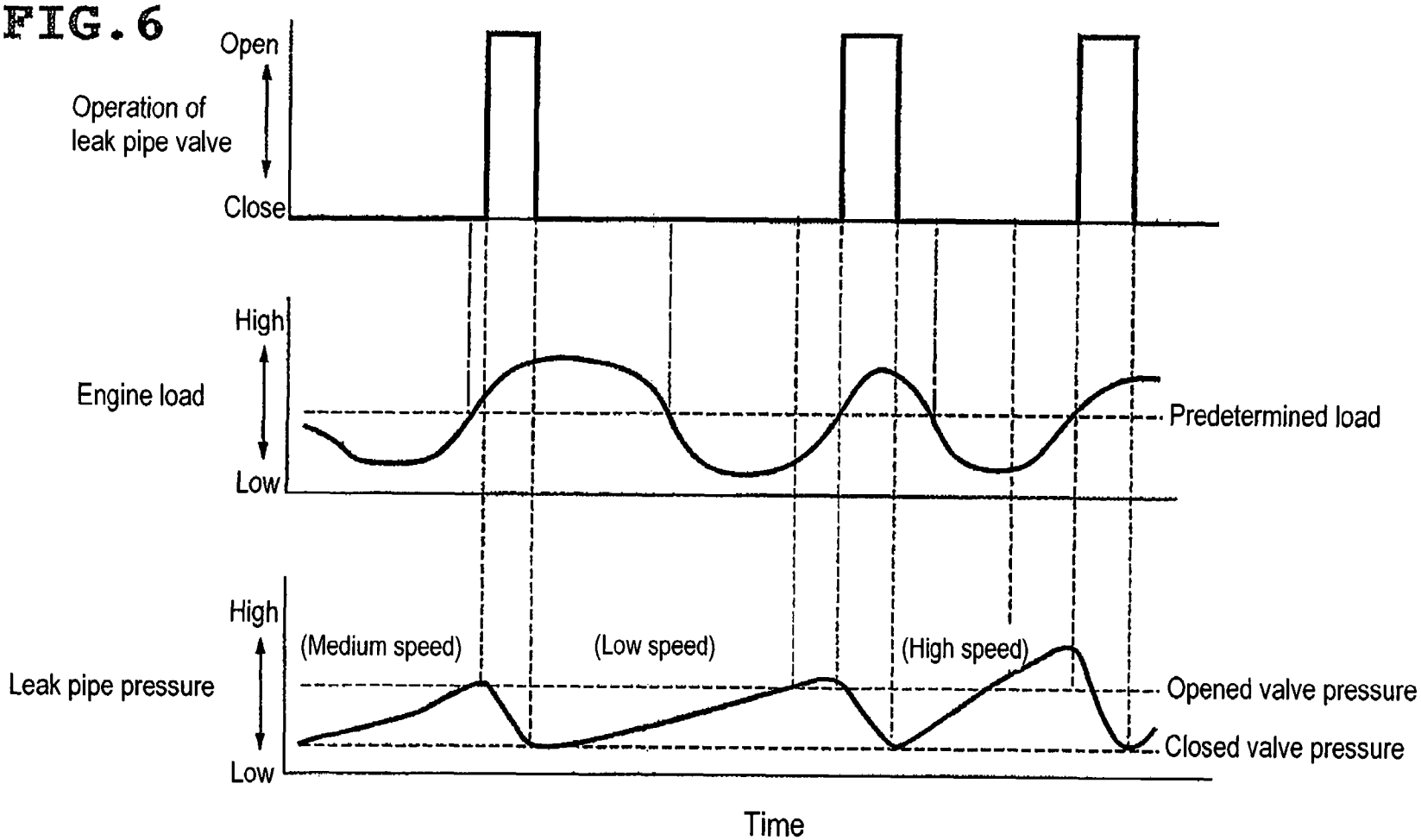
FIG. 6 is an illustration for explaining the operation of the leak pipe valve responding to engine load and the pressure in the leak pipe.

FIG. 4B shows the open/close operation of the leak pipe valve 8 when only the engine load changes with time, FIG. 5B shows the open/close operation of the leak pipe valve 8 when only the pressure in the leak pipe changes with time, and FIG. 6 shows the open/close operation of the leak pipe valve 8 when both the engine load and the pressure in the leak pipe change with time.

Figure 7C:
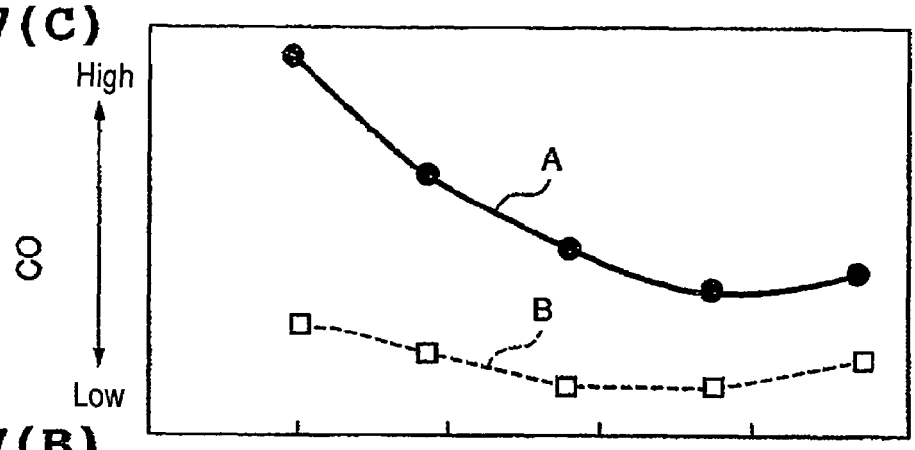
FIG. 7 is a graph showing fuel consumption, HC emission, and CO emission vs. engine load respectively in (A), (B),and (C) when the collection of leaked fuel is done and not done.
Figure 7B:
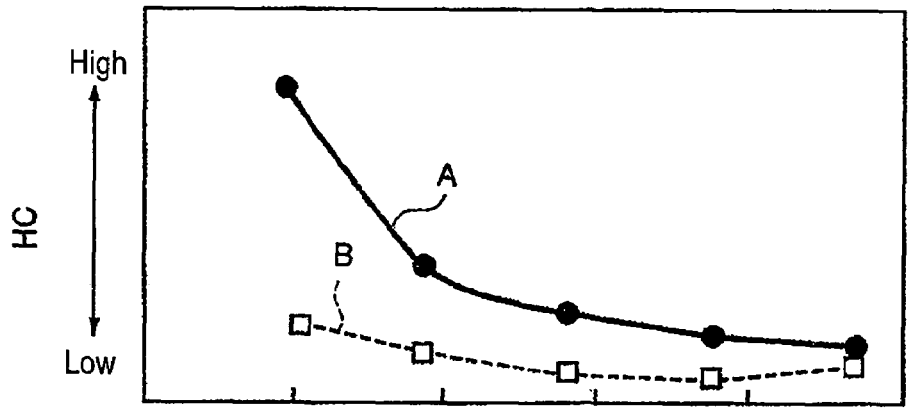

In FIG. 7 are shown respectively in (A), (B), and (C) fuel consumption, HC(hydrocarbon) emission, and CO(carbon monoxide) vs. engine load when the leaked fuel is returned to the intake pipe 6 (indicated with A) and when the leaked fuel is released to the outside (indicated with B).

Figure 7A:
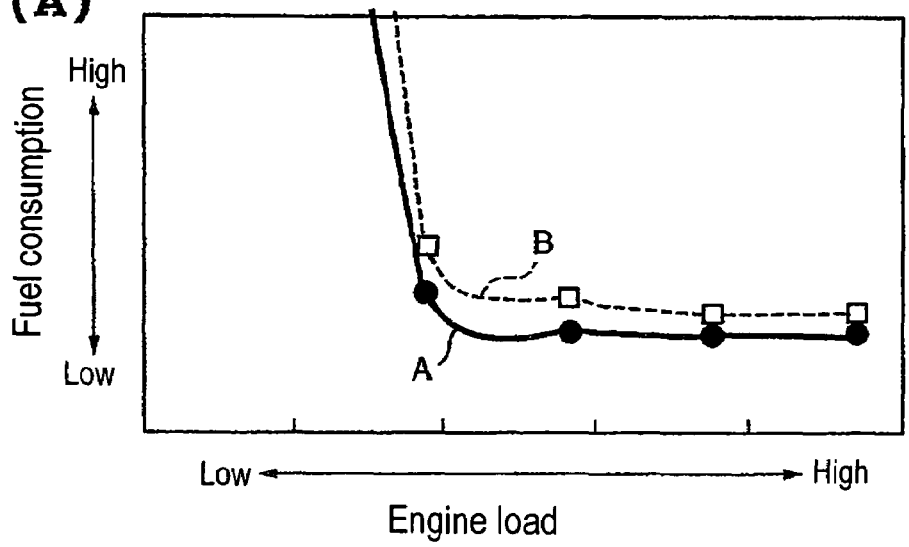

As can be recognized from the graph of FIG. 7(A), fuel consumption can be improved by returning the leaked fuel to the intake pipe 6. When the leaked fuel is returned to the intake air pipe 6, HC and CO emission increase in the low engine load, but this increase in HC and CO emission can be suppressed to the minimum according to the present invention by closing the leak pipe valve 8.

Therefore, according to the present invention, in the range of high load that exceeds the load of $L_0$ determined in correspondence to engine speed, the leaked fuel is introduced to the intake air pipe 6 to be mixed with the intake air to be supplied to the cylinder of the engine 100 and the leaked fuel introduced into the cylinder can be burned well in the cylinder without unburned fuel remained.

In the range of low load, the leak pipe valve 8 is closed until the pressure in the leak oil collection pipe 5 reaches the pressure of $P_0$, and when the pressure in the leak oil collection pipe 5 exceeds the pressure of $P_0$ the leak pipe valve 8 is opened and the leaked fuel increased in pressure in the leak oil collection pipe 5 is introduced into the intake air in the intake air pipe 6 to be mixed with the intake air to produce dense mixture, which is supplied into the cylinder and good combustion with lesser fuel remained unburned can be realized even in a low load range of the engine operation.

Thus, the leaked fuel can be burned in good combustion conditions in all load range of the engine operation.

Also, you can set the open/close switchover point of the leak pipe open/close valve 8 to the predetermined point based on the engine load or the pressure in the leak pipe, instead of controlling the opening and closing of the valve 8 based on the detected value of the pressure in the leak oil collection pipe, the engine load and the engine rotation speed.

INDUSTRIAL APPLICABILITY

As has been described in the foregoing, according to the present invention, an open/close valve is provided in the leak pipe for collecting the leaked fuel, the valve is opened when the engine is operating in the range of high load to introduce the leaked fuel into the intake air passage of the engine, whereby the leaked fuel is mixed with the intake air in the intake air passage and supplied to the cylinder of the engine, and the leaked fuel introduced into the cylinder can be burned well in the cylinder without unburned fuel remained. When the engine operating in the rage of low load, the valve is closed to cut the supply of the leaked fuel to the intake passage, by which the increase in fuel consumption and the deterioration in exhaust emission can be evaded.

By closing the valve in order to store the leaked fuel in the leak oil collection pipe until the pressure in the leak oil collection pipe reaches a certain value and opening the valve when the pressure reaches said certain value to introduce the leaked fuel increased in pressure in the leak oil collection pipe into the intake air passage to be mixed with the intake air, denser fuel/air mixture is supplied to the cylinder and good combustion with lesser fuel remained unburned can be realized even in the range of low load operation.

Therefore, when the engine is operating in the range of high load, the leak fuel introduced into the cylinder in the state mixed the with intake air can be burned well in the cylinder without unburned fuel remained by opening the valve to introduce the leak fuel into the intake air passage of the engine, and when the engine is operating in the range of low load, denser fuel/air mixture is supplied to the cylinder and good combustion with lesser fuel remained unburned can be realized even in the range of low load operation by closing the valve in order to store the leak fuel in the leak oil collection pipe until the pressure in the leak oil collection pipe reaches a certain value and opening the valve when the pressure reaches said certain value to introduce the leaked fuel increased in pressure in the leak oil collection pipe into the intake air passage to be mixed with intake air.

In this way, the leaked fuel can be burned in good combustion conditions in all load range of the engine.

The invention claimed is:

1. A leak fuel collection apparatus of an internal combustion engine for collecting fuel leaked from a fuel injection valve for injecting fuel into a cylinder of the engine, comprising:

a leak fuel passage provided inside the fuel injection valve for collecting the leaked fuel;

a leak oil collection pipe extending between the leak fuel passage and an, intake air passage of the engine;

a leak pipe open/close valve for opening or closing the leak oil collection pipe line; and a controller that controls the leak pipe open/close valve based on an operating condition of the engine.

2. The leak fuel collection apparatus of an internal combustion engine according to claim 1, wherein said controller opens said leak pipe open/close valve when an actual engine load exceeds a predetermined value, and closes said leak pipe open/close valve when the actual engine load is equal to or lower than said predetermined value.

3. The leak fuel collection apparatus of an internal combustion engine according to claim 1, further comprising:

an engine load detector for detecting an engine load; and wherein said controller controls said leak pipe open/close valve based on the detected engine load, such that the leak pipe open/close valve is opened when the detected engine load exceeds a predetermined value, and said leak pipe open/close valve is closed when the detected value of the engine load is equal to or lower than said predetermined value.

4. The leak fuel collection apparatus of an internal combustion engine according to claim 1, wherein said controller opens said leak pipe open/close valve when a pressure in the leak oil collection pipe exceeds a predetermined value and closes said leak pipe open/close valve when the pressure in the leak oil collection pipe is equal to or lower than said predetermined value.

5. The leak fuel collection apparatus of an internal combustion engine according to claim 1, further comprising:

a leak pipe pressure detector for detecting an actual pressure in the leak oil collection pipe, wherein said controller controls the leak pipe open/close valve based on the detected pressure, such that the leak pipe open/close valve is opened when the detected pressure exceeds a predetermined value and closes said leak pipe open/close valve when the detected pressure is equal to or lower than said predetermined value.

6. The leak fuel collection apparatus of an internal combustion engine according to claim 1, wherein said controller opens said leak pipe open/close valve when an engine load exceeds a first predetermined value and the pressure in the leak oil collection pipe exceeds a second predetermined value, and closes said leak pipe open/close valve when the engine load is equal to or lower than said first predetermined value and the pressure in the leak oil collection pipe is equal to or lower than said second predetermined value of pressure.

7. The leak fuel collection apparatus of an internal combustion engine according to claim 1, further comprising:

an engine load detector for detecting an engine load; and a leak pipe pressure detector for detecting a pressure in the leak oil collection pipe, wherein said controller controls the leak pipe open/close valve based on the detected engine load, the detected rotation speed, and the detected pressure, such that the controller opens the leak pipe open/close valve when the detected engine load exceeds a first predetermined value and the detected pressure exceeds a second predetermined value or when the detected engine load is equal to or lower than said first predetermined value and the detected pressure exceeds said second predetermined value, and closes said leak pipe open/close valve when the detected engine load is equal to or lower than said first predetermined value and the detected pressure is equal to or lower than said second predetermined value.

8. The leak fuel collection apparatus of an internal combustion engine according to claim 1, wherein the fuel leaks through clearances at a circumferential of a needle valve of the injection nozzle.

9. The leak fuel collection apparatus of an internal combustion engine according to claim 2, wherein said predetermined engine load is determined based a rotation speed of the engine.

10. The leak fuel collection apparatus of an internal combustion engine according to claim 3, further comprising:

an engine rotation speed detector for detecting a rotation speed of the engine, wherein said predetermined engine load is determined based a detected rotation speed of the engine.

11. The leak fuel collection apparatus of an internal combustion engine according to claim 6, wherein said first predetermined value is determined based a rotation speed of the engine.

12. The leak fuel collection apparatus of an internal combustion engine according to claim 6, wherein said second predetermined value is determined based a rotation speed of the engine.

13. The leak fuel collection apparatus of an internal combustion engine according to claim 7, further comprising:

an engine rotation speed detector for detecting a rotation speed of the engine, wherein said first predetermined value is determined based a detected rotation speed of the engine.

14. The leak fuel collection apparatus of an internal combustion engine according to claim 7, further comprising:

an engine rotation speed detector for detecting a rotation speed of the engine, wherein said second predetermined value is determined based a detected rotation speed of the engine.

* * * * *